US008156947B2

(12) United States Patent
Viola et al.

(10) Patent No.: US 8,156,947 B2
(45) Date of Patent: Apr. 17, 2012

(54) METHOD AND APPARATUS FOR PEDICURE FOOT HEALTH PROTECTION

(76) Inventors: Deanne Viola, Webster, NY (US); Lena Golubkov, Pittsford, NY (US)

( * ) Notice: Subject to any disclaimer, the term of this patent is extended or adjusted under 35 U.S.C. 154(b) by 249 days.

(21) Appl. No.: 12/698,493

(22) Filed: Feb. 2, 2010

(65) Prior Publication Data

US 2011/0186068 A1 Aug. 4, 2011

(51) Int. Cl.
*A45D 7/00* (2006.01)

(52) U.S. Cl. ..... 132/200; 2/239

(58) Field of Classification Search ..... 132/200, 132/73.5; 2/239, 59, 16; 602/3
See application file for complete search history.

(56) References Cited

U.S. PATENT DOCUMENTS 3,896,807 A 7/1975 Buchalter
4,562,834 A 1/1986 Bates et al.
5,682,617 A * 11/1997 Tumas ..... 2/239
5,761,746 A 6/1998 Brown
6,105,173 A 8/2000 Brown
6,274,154 B1 8/2001 Chou
6,423,328 B2 7/2002 Chou
2005/0084649 A1 4/2005 Patlakh
2005/0246821 A1 11/2005 Kopp et al.
2006/0130216 A1 6/2006 Allsebrook
2009/0172867 A1 7/2009 Kopp et al.

* cited by examiner

*Primary Examiner* — Rachel Steitz
(74) *Attorney, Agent, or Firm* — Harris Beach PLLC; Neal L. Slifkin

(57) ABSTRACT

A system for carrying out a pedicure wherein a conventional pedicure is closely simulated while protecting the foot from microbial infection and harsh chemicals. The foot is encased in a waterproof sock containing appropriate liquid conditioners for softening the skin. The encased foot is placed in a warm, recirculating water bath for a period of time. The foot is then removed from the bath, the sock is removed from the foot and discarded, and a conventional pedicure trimming process is carried out. The skin of the foot is thus protected from any contact with the water bath, while the soothing, stimulative, and otherwise pleasurable effects of the recirculating warm water are provided as in a conventional pedicure process.

3 Claims, 1 Drawing Sheet

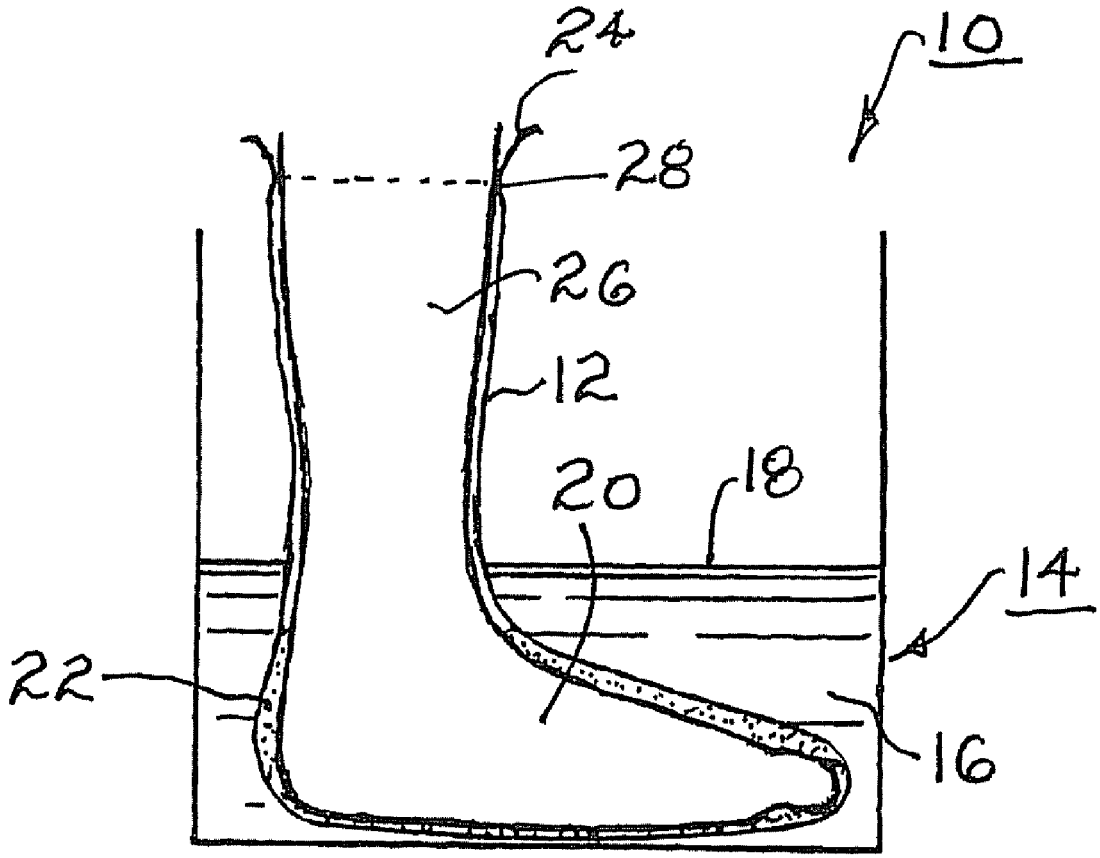
24
10
28
26
12
20
18
14
22
16

METHOD AND APPARATUS FOR PEDICURE FOOT HEALTH PROTECTION

BACKGROUND OF THE INVENTION

The present invention relates to methods and apparatus for carrying out a foot treatment known generally in the art as a pedicure; more particularly, to methods and apparatus for carrying out a pedicure while protecting the foot from microbial infection; and most particularly, to a system (method and apparatus) for carrying out a pedicure by simulation of a conventional circulating water bath pedicure while protecting the foot from contact with the water.

In a conventional prior art pedicure, the foot is first conditioned by being immersed in a warm water bath that is recirculated with agitation for a period of time to soften the skin, especially the cuticles and heel callus. A pedicure is thus an aesthetically satisfying experience. The passage of warm water at high velocity around the foot is pleasant to the client and also serves to beneficially stimulate blood circulation in the foot. The foot is then removed from the bath, one or more lotions, ointments, unguents, and/or medicaments, (referred to generically herein as "liquid conditioners") are applied to the soft, warm skin, and the appropriate trimming processes are carried out.

A known problem in establishments that provide pedicures to the general public is that, although the water bath is changed and the recirculating system is chemically sanitized after each pedicure, infectious micro-organisms in the form of fungi and/or bacteria can persist in the system and can infect succeeding clients. Further, chemicals used in cleaning and sanitizing the water bath system can also be carried over and can undesirably affect the feet of succeeding clients.

It is well known in the art of foot treatments to provide a waterproof foot sock for immersing the foot in one or more conditioners. See, for example, U.S. Pat. No. 5,682,617; Published U.S. Patent Application No. 2006/0130216; and World Published Patent Application WO2009/021299. In each of these disclosures, the foot is encased in a waterproof membrane as described above, but the encased foot is not placed in a heated water bath nor is it contemplated or taught to heat the foot while thus encased. Therefore, in this prior art the salutory benefits of heat and recirculating immersion as in a conventional pedicure are lost to the client.

What is needed in the art is a system (method and apparatus) for carrying out a pedicure wherein a conventional pedicure is closely simulated while protecting the foot from microbial infection and harsh chemicals.

It is a principal object of the invention to protect a foot from microbial and chemical attack during a near-conventional pedicure.

BRIEF SUMMARY OF THE INVENTION

Briefly described, the present invention comprises a system for carrying out an improved pedicure wherein a conventional pedicure is closely simulated while protecting the foot from microbial infection and harsh chemicals. The foot is encased in a waterproof sock containing appropriate liquid conditioners for softening the skin. The encased foot is placed in a warm, recirculating water bath for a period of time. The foot is then removed from the bath, the sock is removed from the foot and discarded, and a conventional pedicure is carried out. The skin of the foot is thus protected from any contact with the water bath, while the soothing, stimulative, and otherwise pleasurable effects of the recirculating warm water are provided as in a conventional pedicure process.

BRIEF DESCRIPTION OF THE DRAWING

The foregoing and other objects, features, and advantages of the invention, as well as presently preferred embodiments thereof, will become more apparent from a reading of the following description in connection with the accompanying drawing in which FIG. 1 is a cross-sectional view of a foot encased in a waterproof sock containing liquid conditioners and immersed in a warm, recirculating water bath in accordance with the present invention.

DETAILED DESCRIPTION OF THE INVENTION

Referring to FIG. 1, a system 10 in accordance with the present invention comprises a disposable waterproof sock 12, formed preferably of a polymer defining a flexible plastic membrane, and a water bath apparatus 14 containing water 16 to a level 18. Apparatus 14 preferably comprises further apparatus (not shown but well known in the pedicure arts) for heating and recirculating water 16 around the immersed portion of sock 12. A user's foot 20 intended for a pedicure treatment in accordance with the present invention is inserted into sock 12 prior to the shown immersion and preferably is accompanied therein by liquid conditioners 22 for softening the foot skin. The top 24 of sock 12 extends above level 18 by an indeterminate distance and preferably is secured to the user's leg 26 near top 24 as by a tie or band 28 to prevent accidental entry of water.

Immersion of foot 20 encased in sock 12 serves a multiplicity of purposes: a) to ensure intimate contact of liquid conditioners 22 with the skin of foot 20, as sock 12 is collapsed by water pressure around foot 20; b) to prevent possible skin infection of foot 20 by any micro-organisms in water 16; and c) to provide to a user the aesthetic satisfaction of a conventional pedicure comprising immersion of foot 20 directly in warm, recirculating water 16; and d) to condition the skin of foot 20 for subsequent conventional pedicure skin trimming processes.

A pedicure method in accordance with the present invention comprises the following steps:

a) encasing a user's foot in a waterproof plastic sock;
b) providing at least one liquid conditioner in the sock in contact with at least those portions of the foot skin intended for subsequent pedicure processing;
c) immersing the encased foot in a warm, recirculating water bath for a period of time;
d) removing the encased foot from the water bath;
e) removing the foot from the waterproof plastic sock; and
f) carrying out conventional pedicure trimming processes.

From the foregoing description, it will be apparent that there has been provided an improved system (method and apparatus) for providing a pedicure wherein a conventional pedicure is closely simulated while protecting the foot from microbial infection and harsh chemicals. Variations and modifications of the herein described system, in accordance with the present invention, will undoubtedly suggest themselves to those skilled in this art. Accordingly, the foregoing description should be taken as illustrative and not in a limiting sense.

The invention claimed is:

1. A pedicure method comprising the following steps:

a) encasing a user's foot in a waterproof plastic sock;

b) providing at least one conditioner in said sock in contact with at least those portions of said foot intended for subsequent pedicure processing;

c) immersing said encased foot in a warm water bath for a period of time;

d) removing said encased foot from said water bath;

e) removing said foot from said waterproof plastic sock; and f) carrying out a least one conventional pedicure trimming process on said removed foot.

2. A method in accordance with claim 1 comprising the step of sealing said flexible waterproof sock to the leg of said user before said immersing step.

3. A method in accordance with claim 1 comprising the step of heating and recirculating said warm water bath at least during said immersing step.

* * * * *